United States Patent [19]

Bell et al.

[11] 4,412,604

[45] Nov. 1, 1983

[54] MULTI-PURPOSE SUITCASE

[76] Inventors: Harry A. Bell; Howard A. Bell, both of 3534 S. Hudson, Seattle, Wash. 98118; Harry W. Bell, 5215 Paul Brown Rd., Lakeland, Fla. 33805

[21] Appl. No.: 337,423

[22] Filed: Jan. 6, 1982

[51] Int. Cl.[3] ..... A47B 85/00; A45G 9/00

[52] U.S. Cl. ..... 190/1; 190/11; 190/102

[58] Field of Search ..... 190/1, 11, 42

[56] References Cited

U.S. PATENT DOCUMENTS

| | | | |
|---|---|---|---|
| 1,325,164 | 12/1919 | Mowrey | 190/11 X |
| 1,378,178 | 5/1921 | Korn | 190/11 UX |
| 2,213,985 | 9/1940 | Howe | 190/11 X |
| 2,277,435 | 3/1942 | Howe | 190/11 X |
| 2,429,362 | 10/1947 | McDowell | 190/11 X |
| 3,298,478 | 1/1967 | Soprani | 190/11 |
| 3,326,337 | 6/1967 | Bell | 190/11 |
| 3,512,620 | 5/1970 | Bell et al. | 190/11 |
| 3,516,523 | 6/1970 | Pemberton, Jr. | 190/11 |
| 3,732,639 | 5/1973 | Elder | 190/11 X |
| 4,258,833 | 3/1981 | Simms | 190/11 |

FOREIGN PATENT DOCUMENTS

| | | | |
|---|---|---|---|
| 150521 | 9/1937 | Austria | 190/11 |

*Primary Examiner*—William Price
*Assistant Examiner*—Sue A. Weaver

[57] ABSTRACT

A combination luggage case, stand to remove contents without stooping over, a table with an extension that can be used as an ironing board or a display table. It has an open topped compartment and a hinged cover for the compartment. Foldable supporting structure includes a fork shaped support for one end and a nose panel for a support in position when opened parallel to the fork shaped support on the other end, thereby forming a stand to remove the contents or to be used as a table. The second position is made by raising the nose to be horizontal and parallel to the floor and supported by an auxiliary leg structure on the nose panel and the case, thus forming an extension table or to be used as an ironing board.

5 Claims, 5 Drawing Figures

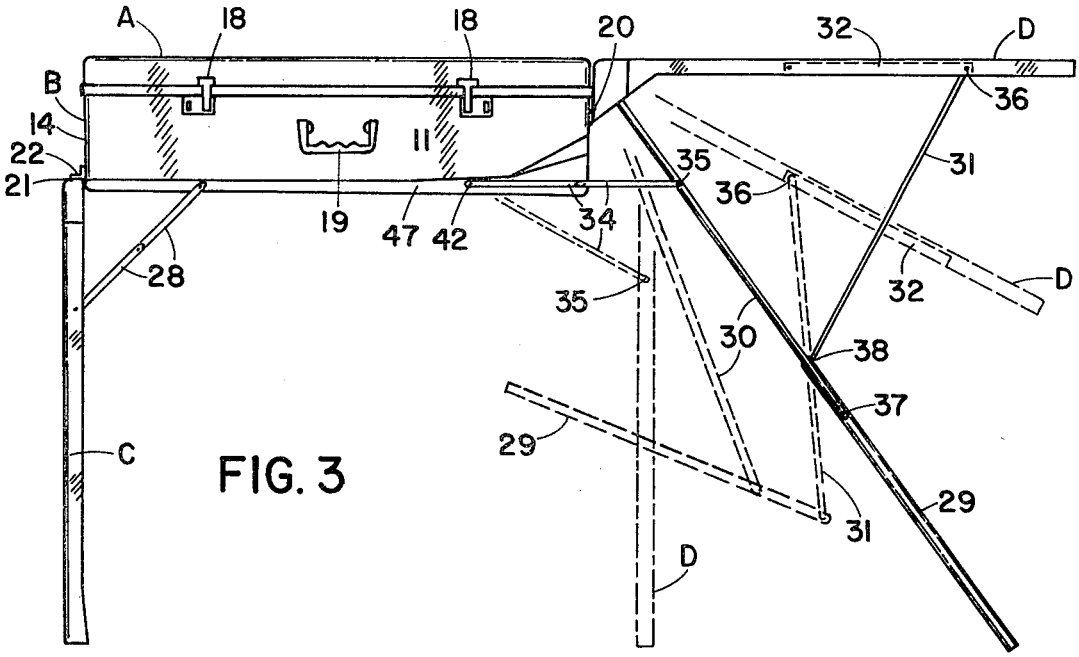
FIG. 3
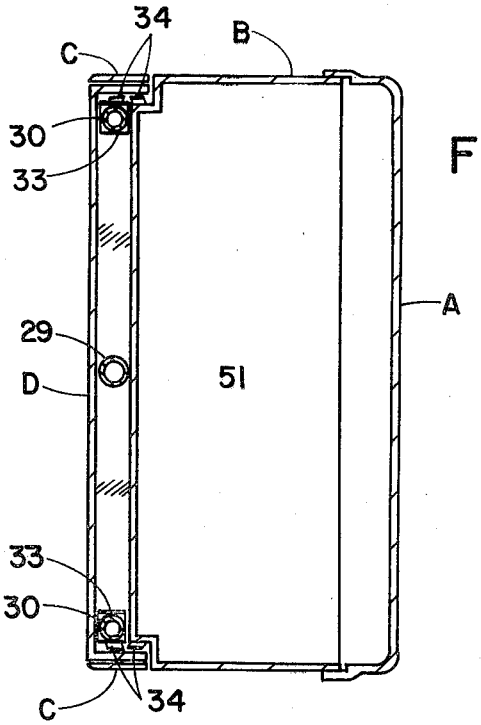
FIG. 4
FIG. 5
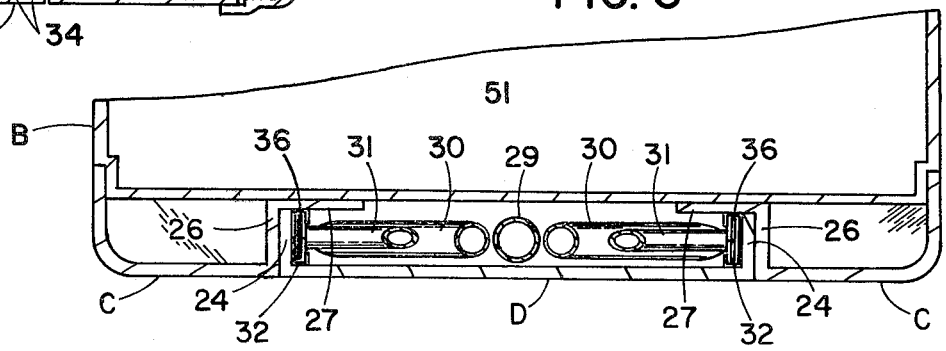

MULTI-PURPOSE SUITCASE

BACKGROUND OF THE INVENTION

The present invention is in the nature of an improvement on the structure disclosed in the prior U.S. Pat. No. 3,512,620 issued to applicants Harry A. Bell, Harry W. Bell and Howard A. Bell. The disclosed structure utilizes a pair of leg members on one end of the suitcase making it necessary to use special large, heavy hinges to be put on the suitcase so as to use it as a table or an ironing board. Because of the table extension extending the full length of the body of the case it was also necessary to use a weak locking system to lock the table extension, or nose support in place when closed. The supports on each end of the suitcase had hinges inverted on the body of the suitcase to fasten them, making it impossible to mold with machinery. It was also necessary to have a passage way cut into the body of the suitcase to let the leg support for the table extension pass through.

SUMMARY OF THE INVENTION

An important object of this invention is that there are only four parts that can now be molded with machinery in a male and female mold or by vacuum molding the parts. Regular luggage hinges can now be used and will support the case better and will be more attractive. Because of the ridge between the hinges on the forked support, the supports can be locked more securely. To close, the fork shaped support is folded in first so that the V shaped nose panel support can fit into it, holding it in place you can insert a penny into a slot on the latch type lock and turn a quarter turn to lock the parts in place. There is no need to cut the body of the case for the leg support for the table extension to pass through. By recessing the corners to provide space for the luggage hinges makes it possible to mold and strengthens the case and improves the design. By recessing the sides of the body of the suitcase where they join the bottom of the body of the suitcase provides space to fasten the support hinges and strengthens the body of the suitcase.

DESCRIPTION OF THE DRAWINGS

FIG. 3 is a view in side elevation showing the device of this invention by movements changing from a table to an ironing board or an extension table.

FIG. 4 is a transverse section taken on the line 4—4 of FIG. 1.

FIG. 5 is an enlarged fragmentary section taken on the line 5—5 of FIG. 1 and rotated substantially 90 degrees.

DETAILED DESCRIPTION

Figure 1:
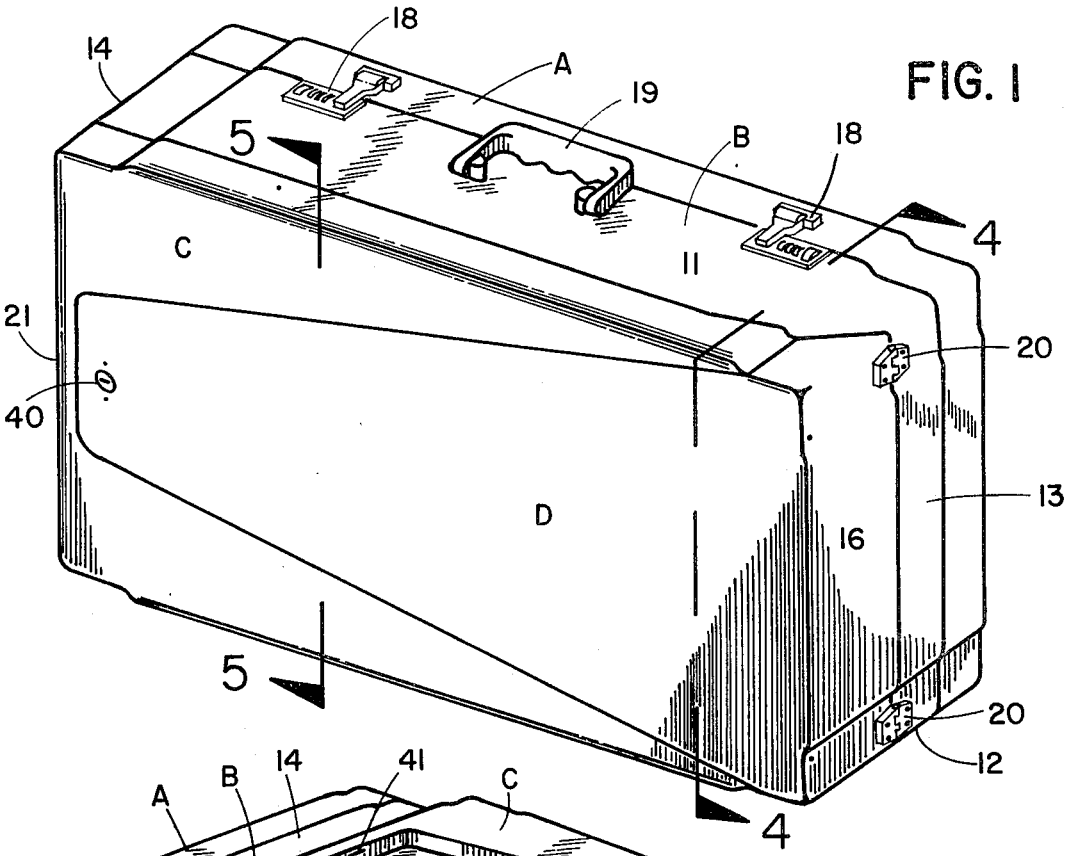
FIG. 1 is a view in perspective of a combination luggage case, ironing board and table, produced in accordance with this invention.

The luggage case of this invention is shown in a closed condition in FIG. 1 and 4, and comprises a rigid generally rectangular frame B including a pair of laterally spaced parallel side walls 11 and 12 and second end panels 13 and 14 respectively, a generally rectangular base or bottom panel 15 rigidly secured to the side and end panels 11 and 14, cooperating therewith to define an open-topped luggage compartment B. The open top of the compartment B is normally closed by a generally rectangular cover A that is secured to the side wall 12 by hinges 17, releasably locked in a closed position by conventional snap locks or latches 18, see particularly FIG. 1 and 2. The cover A as well as the side, end and bottom panels 11–15 are lined with suitable lining material. The case is further provided with a conventional carrying handle 19 shown as being mounted on the exterior of the side panel 11. In the normal loading or unloading position of the case, the side and end panels are generally vertically disposed as in FIG. 3.

Disposed downwardly or outwardly of the base panel is a rigid fork shaped support C and an intermediate section or ironing board nose panel part D, which is selectively used as a supporting leg, as will herein after become apparent. The support part C is releasably locked in its operative case supporting position by a pair of lockable brace members 28 of the folding type normally used on card tables. When the support part C is swung to its folded position of FIG. 1 and 4, one end of brace member 28 is fastened on the recessed side of 47 of the part B and the other end of brace 28 is fastened to support part C. The lateral inner edge of the forked support C is recessed at 26 to allow for support part D to fit within when closed. There is also flange, 27 to hold part C in place when closed, see FIG. 2, 4, 5.

The truncated V-shaped nose panel D is formed to provide inturned longitudinal flanges 24, and outer end flange 25 of its narrow end, and inturned mounting panel 16 at its wide end and gusset portions 23 connecting the adjacebt end portions of the flanges 24 to the mounting panel 16.

The mounting panel 16 is pivotally secured to the end panel 13 by a pair of aligned recessed hinges 20 located so as to dispose the outer surface of the nose panel D in coplanar relationship with the outer surface of the cover A, when the nose panel is pivotally moved into a position to cooperate with the cover A to provide an ironing board or an extended table as shown by full lines in FIG. 3. Recessing of the hinges 20 permits the mounting panel 16 to abut the end panel 13, when the nose panel D is swung into coplanar relationship with the cover A, so that there is no appreciable gap between the cover A and nose panel D, when the nose panel D is moved to its ironing board position.

The nose panel D and the adjacent end of the case are supported by collapsible support means including an auxiliary leg member 29 operatively connected to the interior of the nose panel D by first and second pairs of braces 30 and 31. The braces 30 have the inner ends pivotally mounted in brackets 33 secured to the inside of the nose panel D adjacent the mounting panel 16, and their outer ends pivotally connected to an intermediate portion of the auxiliary leg member 29, as indicated at 37. The braces 31 have inner ends fastened to slides in channels 32. The channels being fastened at points 39 on the nose panel D on the flanges 24. This makes it possible for the leg section 29 to pass the main body B freely when 29 is used to support nose panel D, when it is extended as a table extension or an ironing board. The outer ends of braces 31 are fastened to auxiliary leg member 29 as indicated at 38. The axes of the pivotal connections between the braces 30–31 to the nose panel D and auxiliary leg members 29 are parallel to the common axis of the hinges 20, the arrangement being such that the auxiliary leg member 29 may be swung between an inoperative folded position substantially against the inner surface of the nose panel D and an operative nose panel supporting position shown by full lines in FIG. 3. The auxiliary leg member 29 is provided at its floor engaging end with an inverted rubber tip or like 50 which in the folded position of the auxiliary leg member 29 is disposed closely adjacent the mounting panel 16.

The leg member 29 is releasably held in its folded position by a piece of VELCRO attached to leg member 29 at the center of the leg at its closest side to nose panel D and a mating piece of VELCRO attached to the inner surface of nose panel D. A pair of lockable brace members 34 are each pivotally secured at one end to a different one of the side panels 11 and 12, as indicated at 42, and at their other ends each to a different one of the braces 30 by rivets or the like 35. The base panel 15 of the frame B is recessed where it joins side 11 and 12 to form a space 47 to fasten support hinges 28 and 34 to.

Figure 2:
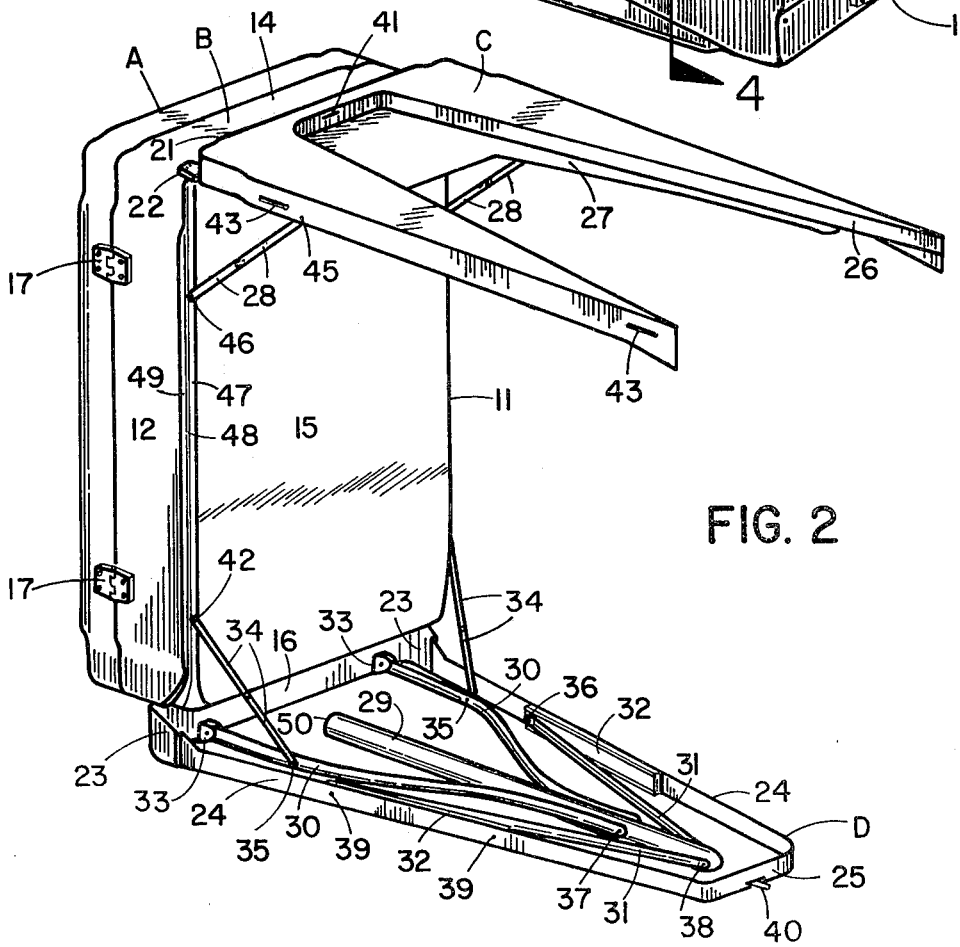
FIG. 2 is a view in perspective of the device of FIG. 1 showing the fork shaped support in an operative position and the nose panel in one of its operative positions.

Not only is the nose panel D utilized as a portion of an ironing board when swung into the plane of the cover A, as above described it may also be utilized as a supporting leg for the adjacent end of the case when it is desired to utilize the case as a table or a stand to remove its contents. When such use is desired, it's only necessary to swing the nose panel D from its folded position against the base panel 15 to a position substantially normal thereto, as shown in FIG. 2 and 3. The nose panel D is releasably held in this position by the lockable brace members 34 and engagement of the auxiliary leg member 29 by the VELCRO. Thus the luggage case is supported at a convenient height above the floor for loading or unloading the contents of the luggage compartment B and with the cover A closed, the same may be used as a table, or like. When it is desired to raise the nose panel D to a level with the cover A, it is only necessary to disengage the auxiliary leg member 29 from the VELCRO and swing the nose panel D outwardly and upwardly to its horizontal operative position. During this outward and upward swinging movement of the nose panel D, the floor-engaging end or tip 50 of the auxiliary leg member 29 will swing inwardly and downwardly toward the end panel 13. It will here be noted that the lockable braces 34 not only hold the nose panel in its intermediate leg forming position of FIG. 2, but also cooperate with the braces 30 and 31 to rigidly brace the auxiliary leg member 29 when the case and nose panel are used as an ironing board. It will be further noted that the floor engaging end portion of the auxiliary leg 29 moves from its ironing board position of FIG. 3, to its folded position of FIG. 2. In FIG. 2 you will note numbers 43 on the forked leg support and they are called studs and are used to set suitcase on if closed with the handle up. When the forked support C and nose panel D are moved to their folded position of FIG. 1, 4 and 5, the forked support C is folded first, then the nose panel D is swung to its closed position. With reference particularly to FIG. 5, it will be seen that, when the nose panel D is moved to its closed or folded position, the side flanges 24 thereof move into face-to-face substantially abutting engagement with the flange 27 of the forked support C making it possible to turn the latch of lock 40 into the cut 41 of the forked support C to make a positive lock. In FIG. 2, 48 is a channel to contain the forked support. In FIG. 4 and 5, 51 represents a cavity of the suitcase.

From the above, it will be seen that the luggage case of this invention may be loaded or unloaded by merely opening the cover A, whether the forked support C and nose panel D be disposed in their folded positions or in either operative position of the nose panel D and operative position of the forked support C. Further, the forked support C and the nose panel D may be moved between their inoperative and operative positions without materially disturbing the contents of the body of the suitcase B. The frame or main body B, cover A, forked support C and nose panel D may be made from any suitable material, but are preferably made from plastic impregnated glass fibers or like materials presently used in the manufacture of luggage. The auxiliary leg 29 and braces 30 and 31 are preferably constructed from aluminum tubing but any light, strong tubing may be used. The lockable hinge braces 28 and 34 being constructed of aluminum or any light, stiff material, plastic or otherwise.

It will be noted that the longitudinal direction of the nose panel D is substantially greater than that of the forked support C, this difference in longitudinal dimensions is compensated for in order to maintain the case substantially level when used as a table or ironing board by disposing the axis of the forked support hinges 22 adjacent the base panel 15, and the axes of the hinges 20 intermediate the base panel 15 and the upper marginal edge thereof.

While a commercial embodiment of our multi-purpose suitcase, stand, table and ironing board has been shown and described, it will be understood that the same is capable of modification without departure from the spirit and scope of the invention, as defined in the claims.

The multi-purpose suitcase is made up of four molded parts, A, B, C, and d. The Combination Luggage Case, Table and Ironing Board prior of U.S. Pat. No. 3,512,620 was made up with five parts and they could not be easily molded with machinery using matched molds or vacuum molding. It also had to have heavy special made hinges twice as heavy as regular luggage hinges.

PART B is the main body of the multi-purpose suitcase.

It has all four corners recessed so as to accommadate two regular hinges on each end. The bottom is recessed on each side to fasten two card table hinges on each end in the recessed area of the side.

PART A is the cover of part B and is recessed to match part B.

PART C is a fork shaped support that is recessed inward with a flange on the inward part and a rib between the recessed part that matches part B, that are for the hinges.

PART D is shaped like the nose of an ironing board and has a flange extending inward at right angles on all the edges to strengthen it and to contain a five piece three section tubing leg support to use when it is desired to use part D as a table extension or an ironing board. It has a channel on the inside of the flange on each side to permit the tubing leg to unfold and support the part D in the same place as part A, making it unnecessary to cut a slot in part B for this leg to pass through as in U.S. Pat. No. 3,512,620. Part D is hinged on the opposite end of part B that part C is hinged to. When part D is opened parallel to part C, it becomes a stand to remove the contents from part B or to become a table. Part D is made to fit into part C and it has a lock in the end of the nose to lock into part C when it is folded together.

What is claimed is:

1. A composite, rectangular, molded suitcase, table and ironing board; the suitcase comprising a molded, hollow, rectangular cover and body portion; a molded, truncated V-shaped ironing board hinged to one end of the body portion; a molded, fork-shaped support hinged to the other end of the body portion and receiving the truncated V-shaped ironing board to form a smooth-surface rectangular bottom; the four corners of the composite suitcase, table and ironing board being recessed inwardly in the depth dimension.

2. The composite suitcase, table and ironing board of claim 1, including first hinge means connected to the respective ends of the body portion and each of the ironing board and support; said first hinge means being located in the recessed corners.

3. The composite suitcase, table, and ironing board of claim 2, wherein said body portion includes a recessed portion along each of the bottom longitudinal edges to receive second hinge means and the longitudinal edges of the support.

4. The composite suitcase, table and ironing board of claim 3, wherein said ironing board includes a support leg and pivotal means located on the inside surface of the board to permit the board to be supported in the same plane as the upper surface of the cover when it is closed.

5. The composite suitcase, table and ironing board of claim 4, wherein said first hinge means, second hinge means, support leg and pivotal means function to locate the support as leg means to support one side of the bottom of the suitcase and the ironing board to function as leg means to either support the other bottom side of the suitcase or the ironing board to be supported in a plane with the upper surface of the closed cover.

* * * * *